US011443888B2

(12) United States Patent
Ashizawa et al.

(10) Patent No.: US 11,443,888 B2
(45) Date of Patent: Sep. 13, 2022

(54) COIL COMPONENT AND COIL DEVICE

(71) Applicant: TDK CORPORATION, Tokyo (JP)

(72) Inventors: Syun Ashizawa, Tokyo (JP); Takahiro Banzai, Tokyo (JP); Satoshi Sugimoto, Tokyo (JP); Hitoshi Sasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 752 days.

(21) Appl. No.: 16/392,834

(22) Filed: Apr. 24, 2019

(65) Prior Publication Data

US 2019/0348211 A1 Nov. 14, 2019

(30) Foreign Application Priority Data

May 9, 2018 (JP) ..... JP2018-090812

(51) Int. Cl.

| | |
|---|---|
| ***H01F 27/02*** | (2006.01) |
| ***H01F 27/28*** | (2006.01) |
| ***H01F 27/32*** | (2006.01) |
| ***H01F 27/255*** | (2006.01) |

(52) U.S. Cl.
CPC ..... *H01F 27/2804* (2013.01); *H01F 27/255* (2013.01); *H01F 27/32* (2013.01)

(58) Field of Classification Search
CPC ..... H01F 27/2804
USPC ..... 336/83
See application file for complete search history.

(56) References Cited

U.S. PATENT DOCUMENTS

| | | | | |
|---|---|---|---|---|
| 2004/0189430 | A1 | 9/2004 | Matsutani et al. | |
| 2006/0145804 | A1 * | 7/2006 | Matsutani | H01F 27/292 336/200 |

FOREIGN PATENT DOCUMENTS

| | | | |
|---|---|---|---|
| JP | S53-095136 | U | 8/1978 |
| JP | H05-062006 | U | 8/1993 |
| JP | H06-077077 | A | 3/1994 |
| JP | 2003-188026 | A | 7/2003 |
| JP | 2004-111457 | A | 4/2004 |
| JP | 2004-296630 | A | 10/2004 |
| JP | 2013-187454 | A | 9/2013 |

* cited by examiner

*Primary Examiner* — Ronald Hinson
(74) *Attorney, Agent, or Firm* — Oliff PLC

(57) ABSTRACT

A coil component including a first conductive plate part formed with a first coil pattern having a first opening, and a second conductive plate part formed with a second coil pattern having a second opening and disposed at a predetermined interval in the laminating direction with respect to the first conductive plate part. The first conductive plate part and the second conductive plate part are made of the same single plate and are integrally formed by a bent joining segment.

17 Claims, 12 Drawing Sheets

COIL COMPONENT AND COIL DEVICE

BACKGROUND OF THE INVENTION

The invention relates to a coil device used as such as an inductor and to a coil component disposed inside the coil device.

Many coil devices used as such as the inductor are mounted in various electronic and electric equipments. As an example of the coil component constituting the coil device, a coil component disclosed in the below Patent Document 1 has been developed. In the coil component disclosed in the below Patent Document 1, the coil component is constituted by forming a connection part and a bending part in a portion protruding from an annular coil pattern.

However, as the thickness of a conductive plate part constituting the coil component increases due to the miniaturization in size and the increase in current of the coil device, the connection part and the bending part protruding from the annular part cannot cope with downsizing.

In particular, when the coil device shown in Patent Document 1 is covered with the core made of a compression body including such as magnetic powder to constitute the coil device, the connection part and the bending part that protrude largely from the annular coil pattern are also covered with the core, and there is a problem that miniaturization in size of the coil device cannot be achieved. In addition, since the core covers the connection part and the bending part protruding from the annular coil pattern, the core covers a waste part that does not function as the coil, which is a waste of material and leads to an increase in cost.

Patent Document 1: Japanese Unexamined Patent Application Publication No. 2013-187454

BRIEF SUMMARY OF INVENTION

The invention has been made in view of such circumstances, and an object thereof is to provide a coil component and a coil device which are easy to satisfy both miniaturization in size and an increase in current of the coil component.

In order to achieve the above object, the coil component according to the invention includes a first conductive plate part formed with a first coil pattern having a first opening, a second conductive plate part formed with a second coil pattern having a second opening and disposed at a predetermined interval in the laminating direction with respect to the first conductive plate part, and a bent joining segment connecting the first conductive plate part and the second conductive plate part, wherein the bent joining segment is made of the same single plate with the first conductive plate part and the second conductive plate, and the bent joining segment directly connects a part of a first outer edge of the first coil pattern contacting (forming or defining) the first opening with a part of a second outer edge of the second coil pattern contacting (forming or defining) the second opening.

In the coil component according to the embodiment, the bent joining segment directly connects a part of the first outer edge of the first coil pattern forming the first opening and a part of the second outer edge of the second coil pattern forming the second opening. Therefore, it is possible to minimize the protruding amount of the bent joining segment protruding from the annular first coil pattern and the annular second coil pattern. Thus, it is easy to miniaturize the coil component in size.

In addition, since it is easy to reduce the size of the coil component, it is also easy to reduce the size of the coil device including the coil component and a compressed powder body having the coil component integrally incorporated therein. Further, since it is easy to reduce the size of the coil component, it is easy to reduce the size of the coil device including the coil component and the core member to which the coil component is mounted therein. Also, it is easy to make the first conductive plate part forming the first coil pattern and the second conductive plate part forming the second coil pattern to be relatively thick, and it becomes possible to increase the current flow flowing through the coil patterns.

Preferably, the bent joining segment is connected to the first coil pattern by a predetermined first end length extending from the first pattern end point of the first coil pattern along a periphery of the first opening, and to the second coil pattern by a predetermined second end length extending from the second pattern end point of the second coil pattern along a periphery of the second opening.

The width of the connection between the bent joining segment and the first coil pattern corresponds to the first end length, and the width of the connection between the bent joining segment and the second coil pattern corresponds to the second end length. And by keeping the lengths within the predetermined range, it is possible to suppress an increase in the electrical resistance at these connections.

Preferably, the first end length is longer than a first width of the first coil pattern, and the second end length is longer than a second width of the second coil pattern. With such configuration, it becomes possible to suppress a decrease in the cross sectional area of the bent joining segment and to suppress an increase in electrical resistance, even when the thickness of the bent joining segment is made thin. In addition, the first end length and the second end length are substantially the same. It is preferable that the width of the bent joining segment is substantially the same along the bending direction. The bent joining segment is not necessarily arranged at the same position toward the laminating direction, and both edge lines of the bent joining segment in the width direction may be inclined.

A first cutout recessed in the direction towards the first opening may be formed on the first coil pattern at a position apart from the first pattern end point by the first end length, and a second cutout recessed in the direction towards the second opening may be formed on the second coil pattern at a position apart from the second pattern end point by the second end length.

With such configuration, it is possible to further reduce the protruding amount of the bent joining segment projecting from the annular first coil pattern and the annular second coil pattern. Therefore, it is possible to further downsize the coil component.

Preferably, a bending concave is formed on a curved inner surface or a curved outer surface of the bent joining segment. The thickness of the bent joining segment may be smaller than the first thickness of the first coil pattern and smaller than the second thickness of the second coil pattern.

With the configuration, it is possible to further reduce the protruding amount of the bent joining segment, which protrudes from the annular first coil pattern and the annular second coil pattern. Therefore, it is possible to further reduce the size of the coil component. Further, by reducing the thickness of the bent joining segment, it becomes easy to further reduce the gap in laminating direction between the first coil pattern and the second coil pattern. As a result, it becomes possible to strengthen the magnetic coupling between these coil patterns, and such as the metal magnetic powder contained in the compressed powder body becomes difficult to enter between the coil patterns. Therefore, it becomes difficult to generate such as a short-circuit failure.

An insulating member is interposed between the first coil pattern and the second coil pattern. An adhesive is exemplified as the insulating member.

The first conductive plate part may have a first lead part connected to the first coil pattern at a first start point by a predetermined first start length extending from the first pattern start point of the first coil pattern along the periphery of the first opening.

The first lead part is preferably bent from a plane of the first coil pattern toward the laminating direction. With such configuration, it is possible to further reduce the size of the coil component. Preferably, a taper having a narrower width toward the distal end is formed at the distal end of the first lead part.

The distal end of the first lead part is exposed from such as the compressed powder body and forms a connection with the mounting part. By forming a taper at the distal end of the first lead part, it is possible to easily avoid contact with the compressed powder body containing the metallic magnetic material. And it is possible to effectively prevent a short circuit with the metallic magnetic material.

Preferably, the first conductive plate part other than the distal end of the first lead part is covered with an insulating layer. With such configuration, for example, it is possible to easily avoid contact with the compressed powder body containing a metallic magnetic material, and it is possible to effectively prevent a short circuit between the first conductive plate part and the metal magnetic body.

The second conductive plate part may have a second lead part connected to the second coil pattern at a second start point by a predetermined second start length extending from the second pattern start point of the second coil pattern along the periphery of the second opening. Preferably, the second lead part is bent from a plane of the second coil pattern toward the laminating direction and located outside the first coil pattern. With such configuration, it is possible to further downsize the coil component. Further, preferably, a distal end of the second lead part forms the taper whose width becomes narrower toward the distal end, similar to the first lead part. Also, preferably, the second conductive plate part is also covered with an insulating layer other than the front end part of the second lead part, similar to the first conductive plate part.

An inner side surface positioned at an end in a longitudinal direction of the first opening may have a first arcuate inner curved surface, an outer side surface of the first conductive plate part corresponding to the first arcuate inner curved surface may have a first corner protrusion, an inner side surface positioned at an end in a longitudinal direction of the second opening may have a second arcuate inner curved surface, and an outer side surface of the second conductive plate part corresponding to the second arcuate inner curved surface may have a second corner protrusion.

With such configuration, it becomes possible to extend the magnetic flux even to the core member or the compressed powder body located near the first corner protrusions and the second corner protrusions and to spread the magnetic flux to the entire core member and compressed powder body. And, it is possible to effectively use the corners of the core or the compressed powder body. Further, in the first corner protrusions, the cross sectional area of the first conductive plate part is widened and the electric resistance is lowered, and the cross sectional area of the second conductive plate part is widened and the electric resistance is lowered.

The coil device according to the first aspect of the invention includes the coil component described in any one of the above, and a compressed powder body containing a magnetic material, integrally covering an inside of the first opening, an inside of the second opening, an outer surface of the first coil pattern, an outer surface of the second coil pattern, and an outer surface of the bent joining segment of the coil component.

The coil device according to the second aspect of the invention includes the coil component described in any one of the above, and the core member compacted from a magnetic material and having the coil component mounted therein. The core member includes a central leg inserted into the insides of the first and the second openings of the coil component, a planar base disposed on an outer surface in the axial direction of the first coil pattern and an outer surface in the axial direction of the second coil pattern, and an outer leg disposed on an outer side surface of the first coil pattern, an outer side surface of the second coil pattern, and an outer side surface of the bent joining segment.

DETAILED DESCRIPTION OF THE INVENTION

Figure 1:
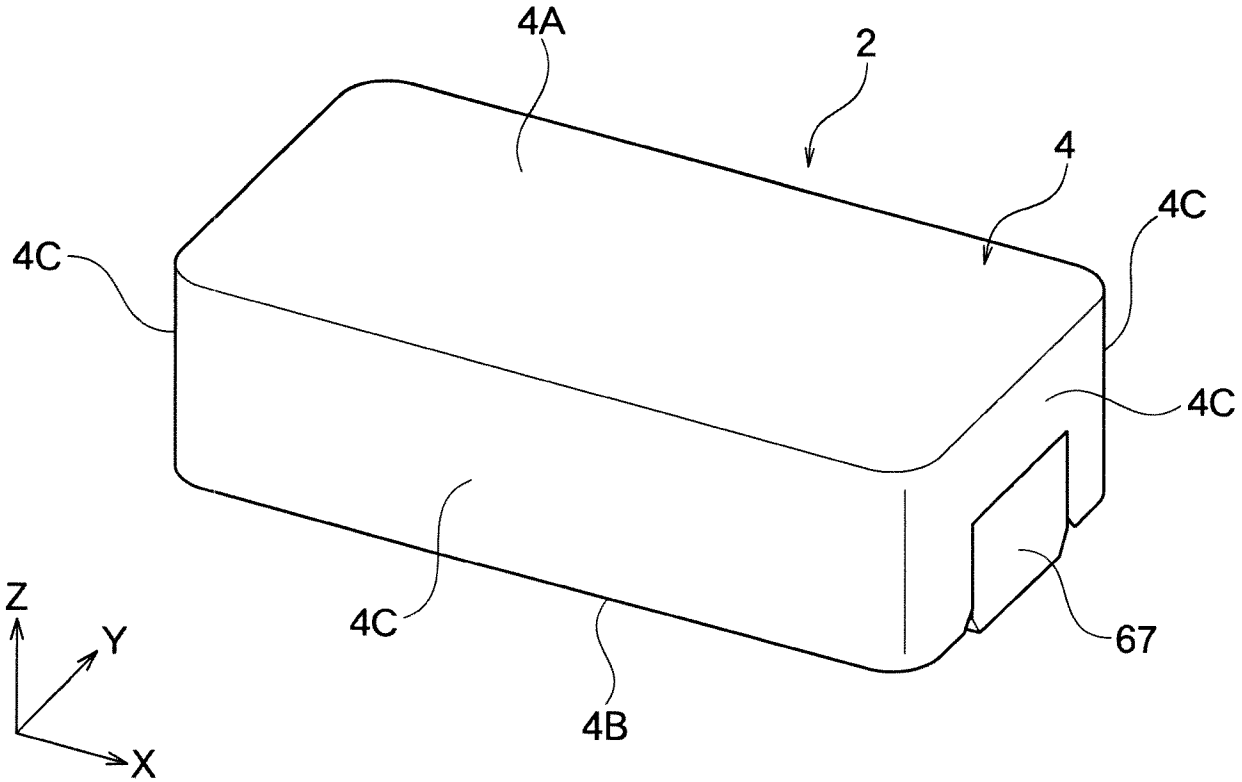
FIG. 1 is a schematic perspective view of the coil device according to an embodiment of the invention.

Hereinafter, the invention will be described based on embodiments shown in the drawings.

First Embodiment

As shown in FIG. 1, an inductor element 2 as the coil device in an embodiment of the invention has a core (sealing body) 4 as a powder compact. In the embodiment, the core 4 has an approximate hexahedral shape, and has an upper surface 4A, a lower surface 4B located on the opposite side of the upper surface 4A in the Z-axis direction, and four side surfaces 4C. In the embodiment, the lower surface 4B is a mounting surface for connection to such as a circuit board.

The upper surface 4A of the core 4 is an outer surface opposite to the mounting side, substantially parallel to the lower surface 4B, and the four side surfaces 4C are substantially perpendicular to these upper and lower surfaces. However, the shape of the core 4 is not particularly limited, and it is not limited to a hexahedron but may be a cylindrical shape, an elliptical column, a polygonal column, etc.

Figure 2:
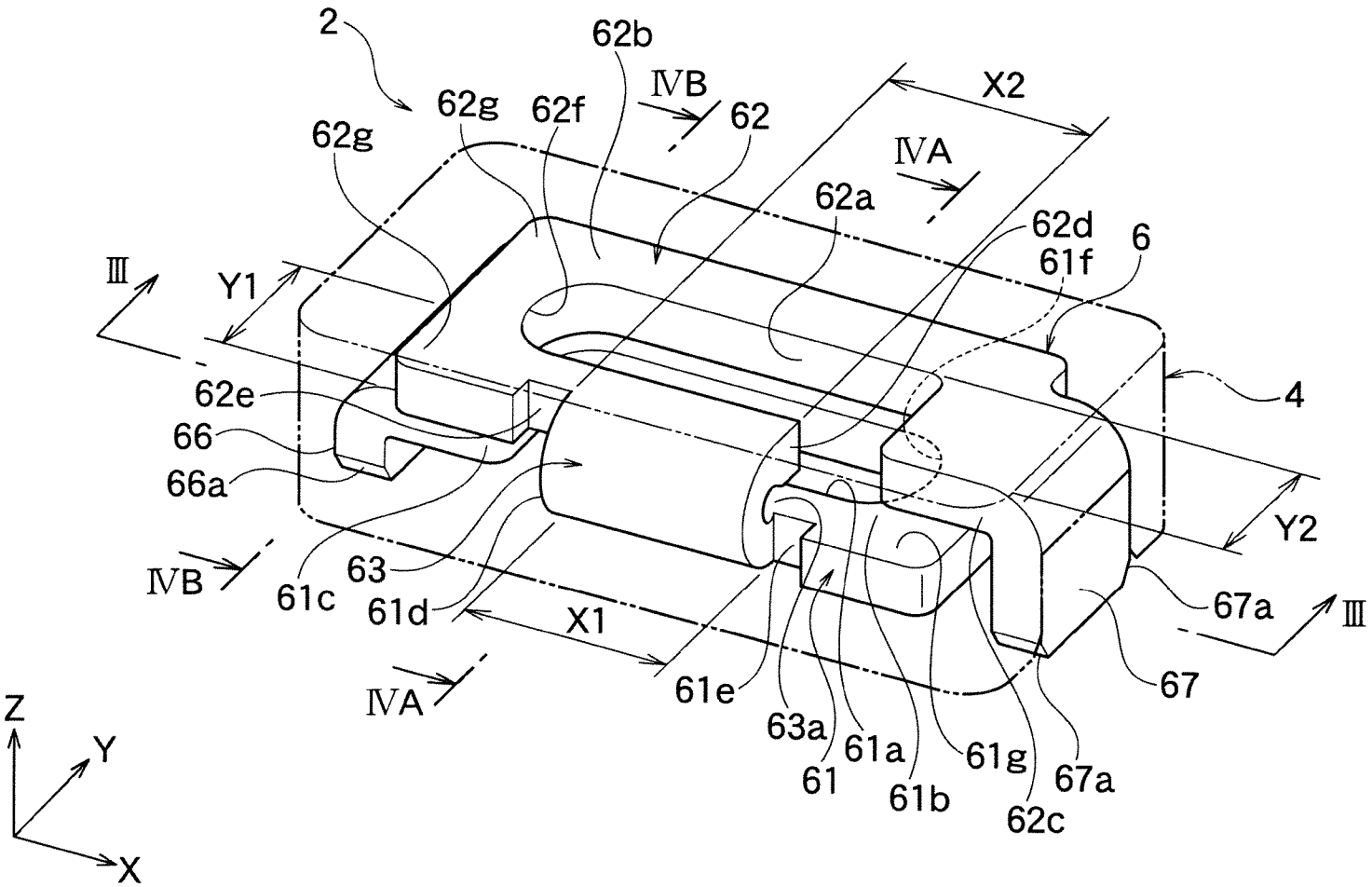
FIG. 2 is a perspective view of the coil component incorporated in the coil device shown in FIG. 1.
Figure 3:
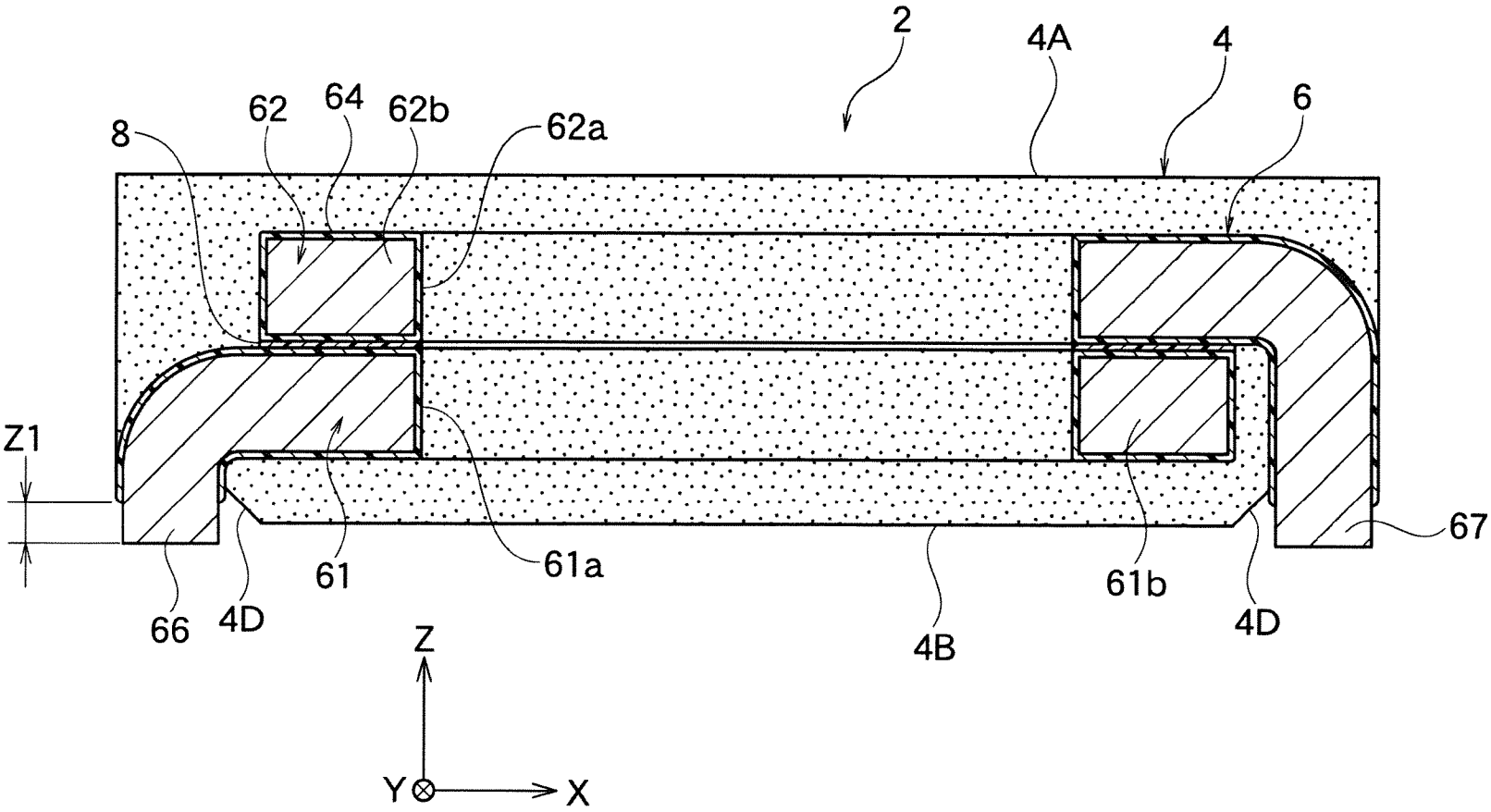
FIG. 3 is a cross-sectional view of the coil device along the line III-III shown in FIG. 2.

Further, in the embodiment, the core 4 is formed so as to be elongated in the X-axis direction rather than the Y-axis direction. And the lead parts 66 and 67 shown in FIG. 2 are formed and exposed on the side surface 4C in the X-axis direction. As shown in FIG. 3, the distal ends of the lead parts 66 and 67 are attached to the core 4 so as to protrude downward in the Z-axis direction lower than the lower surface 4B of the core 4. In the drawings, X-axis, Y-axis and Z-axis are substantially perpendicular to each other. And in the embodiment, Z-axis matches the vertical direction of the coil unit 2 and X-axis matches the longitudinal direction of the coil unit 2.

As shown in FIG. 2, the coil component 6 is mounted inside the core 4. The main part of the coil component 6 is covered with the core 4. The main part of the coil component 6 is a part excluding a part of the lead parts 66 and 67 exposed from the core 4.

As shown in FIG. 3, in the embodiment, it is preferable that most of the end faces in the X-axis direction of the lead parts 66 and 67 are exposed from the core 4. The lead parts 66 and 67 are however not always necessary to be exposed and may be embedded in the core 4. Since the lower ends of the respective lead parts 66 and 67 in the Z-axis direction become connections with the circuit board, it is preferable that they are exposed from the core 4 at least within a predetermined height Z1 in the Z-axis direction. The predetermined height Z1 is preferably 0.1 to 0.5 mm.

Figure 4A:
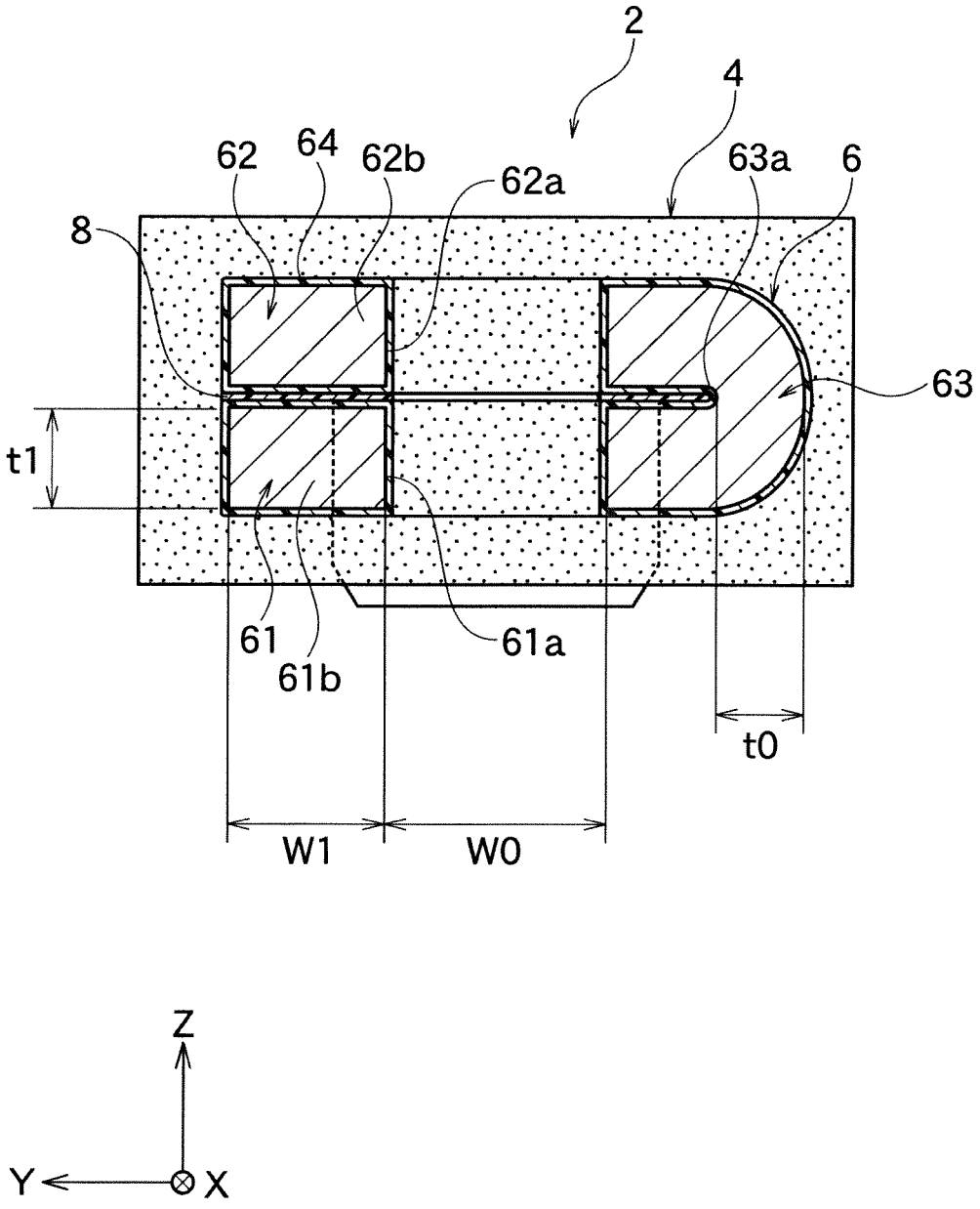
FIG. 4A is a cross-sectional view of the coil device along the line IVA-IVA shown in FIG. 2.
Figure 4B:
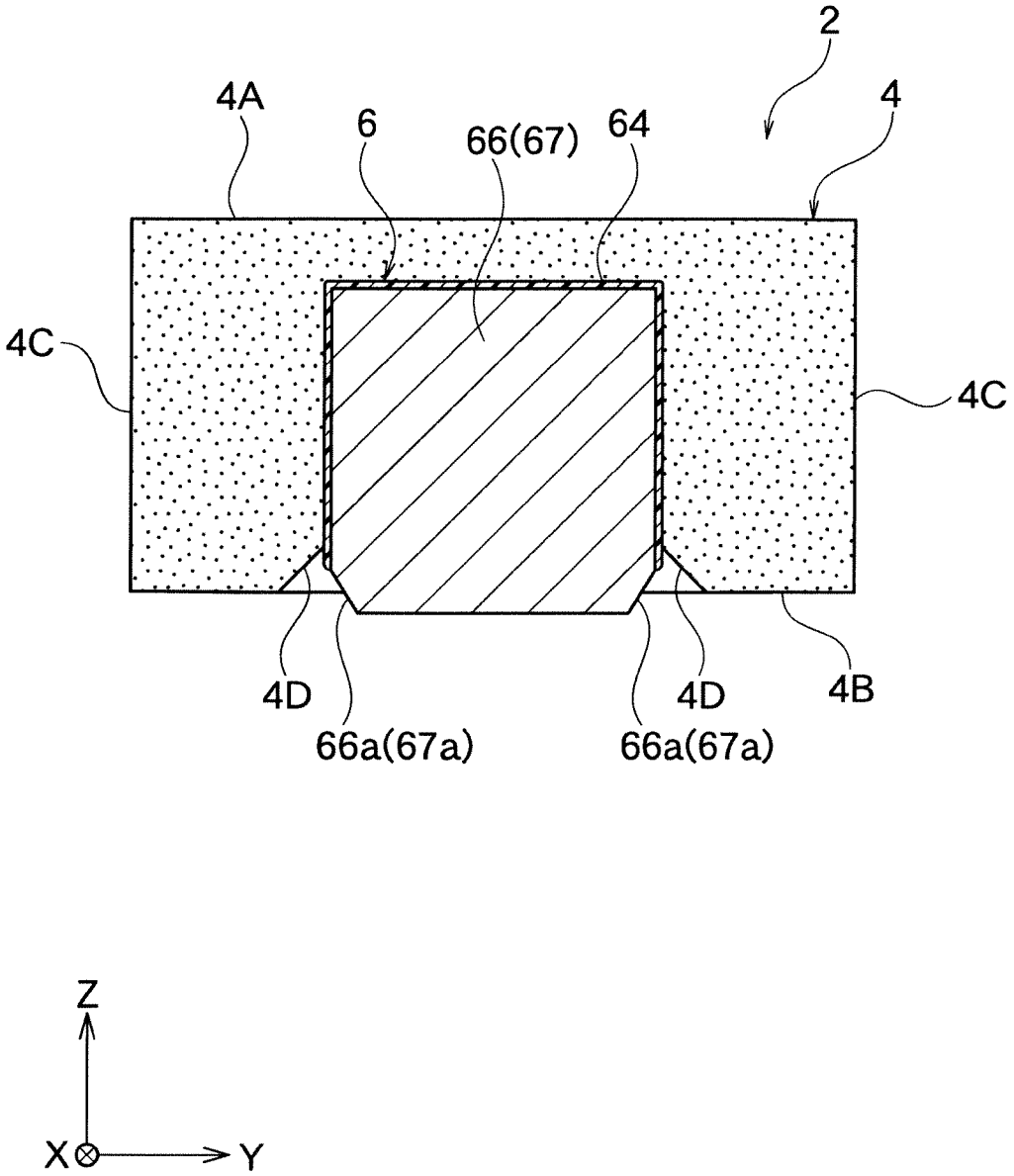
FIG. 4B is a cross-sectional view of the coil device along the line IVB-IVB shown in FIG. 2.

In order to expose the lower end of each lead part 66 and 67 in the Z-axis direction in a range not less than the predetermined height Z1 not to contact the core 4, as shown in FIGS. 3 and 4B, a tapered concave 4D extending downward in the Z-axis direction is formed on the lead extraction part of the core 4. For the same reason, as shown in FIG. 4B, it is preferable that a taper is formed at the lower end in the Z-axis direction of each lead parts 66 and 67 in order to make the width in the Y-axis direction and/or the thickness in the X-axis direction toward the lower end in the Z-axis direction small.

With the configuration, it is possible to easily connect the lower ends of each lead part 66 and 67 to the land parts of the circuit board with such as solder, and the solder becomes difficult to adhere to the lower surface 4B of the core 4. Note that the insulating layer 64 described later is peeled at the lower ends of each lead part 66 and 67, and the surfaces of the metals constituting the lead parts 66 and 67 are exposed.

As shown in FIGS. 2 and 3, the coil component 6 has a multiple conductive plate parts laminated in the Z-axis direction (laminating direction). In the below-described embodiment, the two first and second conductive plate parts 61 and 62 are laminated in the Z-axis direction to form the coil component 6, but the invention is not limited thereto.

As shown in FIG. 2, the first coil pattern 61*b* having the first opening 61*a* is formed on the first conductive plate part 61. The second conductive plate part 62 is disposed at a predetermined interval in the laminating (Z-axis) direction with respect to the first conductive plate part 61. The second coil pattern 62*b* having the second opening 62*a* is formed on the second conductive plate part 62. The second opening 62*a* communicates with the first opening 61*a* in the Z-axis direction and has substantially the same size with the first opening 61*a*.

In the embodiment, the first coil pattern 61*b* has a pattern that surrounds the first opening slenderly elongated in the X-axis direction by approximately less than one round from the first pattern start point 61*c* to the first pattern end point 61*d*. A first cutout part is formed between the first pattern start point 61*c* and the first pattern end point 61*d*, and the first opening 61*a* is opened toward the outside at the first cutout. The cutout width of the first cutout part in the X-axis direction is not particularly limited as long as it is a width that maintains insulation between the first pattern start point 61*c* and the first pattern end point 61*d*.

The second coil pattern 62*b* has a pattern that surrounds the second opening slenderly elongated in the X-axis direction by approximately less than one round from the second pattern starting point 62*c* to the second pattern end point 62*d*. A second cutout part is formed between the second pattern starting point 62*c* and the second pattern end point 62*d*, and the second opening 62*a* is opened toward the outside at the second cutout. The cutout width of the second cutout part in the X-axis direction is not particularly limited as long as it is a width that maintains insulation between the second pattern start point 62*c* and the second pattern end point 62*d*.

In the embodiment, the first conductive plate part 61 and the second conductive plate part 62 are connected by a bent joining segment 63, made of the same single plate as the first conductive plate part 61 and the second conductive plate part 62. The bent joining segment 63 directly connect a part of the first outer edge of the first coil pattern 61*b* contacting (defining) the first opening 61*a* and a part of the second outer edge of the second coil pattern 62*b* contacting (defining) the second opening 62*a*.

That is, the bent joining segment 63 is integrally connected to the first outer edge of the first coil pattern 61*b* by a predetermined first end length X1 (the length in the X-axis direction) along a periphery of the first opening 61*a* from the first pattern end point 61*d* of the first coil pattern 61*b*. Further, the bent joining segment 63 is integrally connected to the second outer edge of the second coil pattern 62*b* by a predetermined second end length X2 (the length in the X-axis direction) along a periphery of the second opening 62*a* from the second pattern end point 62*d* of the second coil pattern 62*b*.

These end lengths X 1 and X 2 are preferably approximately the same but may be different. Further, in the embodiment, the X-axis direction position of the connection between the first coil pattern 61*b* and the bent joining segment 63, and the X-axis direction position of the connection between the second coil pattern 62 and the bent joining segment 63 are substantially the same but may be out of position in the X-axis direction.

In the embodiment, the first cutout 61*e* is preferably formed on the first coil pattern 61*b* at a position apart from the first pattern end point 61*d* by a first end length X1. The first cutout 61*e* is recessed in the direction opposite to the bending direction of the bent joining segment 63 (the direction towards the first opening 61*a*). Further, the second cutout 62*e* is preferably formed on the second coil pattern 62*b* at a position apart from the second pattern end point 62*d* by a second end length X2. The second cutout 62*e* is recessed in the direction opposite to the bending direction of the bent joining segment 63 (the direction towards the second opening 62*a*).

These cutouts 61*e* and 62*e* are not necessarily provided, but by being provided, it is possible to further reduce the protrusion amount of the bent joining segment 63 projecting in the Y-axis direction from the annular first coil pattern 61*b* and the annular second coil pattern 62*b*. Therefore, it is possible to further downsize the coil component 2.

The width in the X-axis direction of each cutout 61*e* and 62*e* is not particularly limited, but it is preferably around 0.1 to 2 times the thickness (thickness in the Z-axis direction) of the first conductive plate part 61 or the same of the second conductive plate part 62. The depth in the Y-axis direction of each cutout 61*e* and 62*e* is not particularly limited, but it is preferably around 0.1 to 0.7 times the width (width in the Y-axis direction) of the first conductive plate part 61 or the same of the second conductive plate part 62.

In addition, a recess 63*a* for bending is formed on the bent inner surface of the bent joining segment 63. As shown in FIG. 4A, at the recess 63*a* for bending, the thickness t0 of the bent joining segment 63 is smaller than the representative first thickness t1 of the first coil pattern 61*b*. The representative first thickness t1 of the first coil pattern 61*b* is substantially equal to the second thickness of the second coil pattern 62*b* and is equal to the thickness of the metal plate constituting these patterns. t0/t1 is 1 or less, preferably 0.3 or more and less than 1.

Figure 2A:
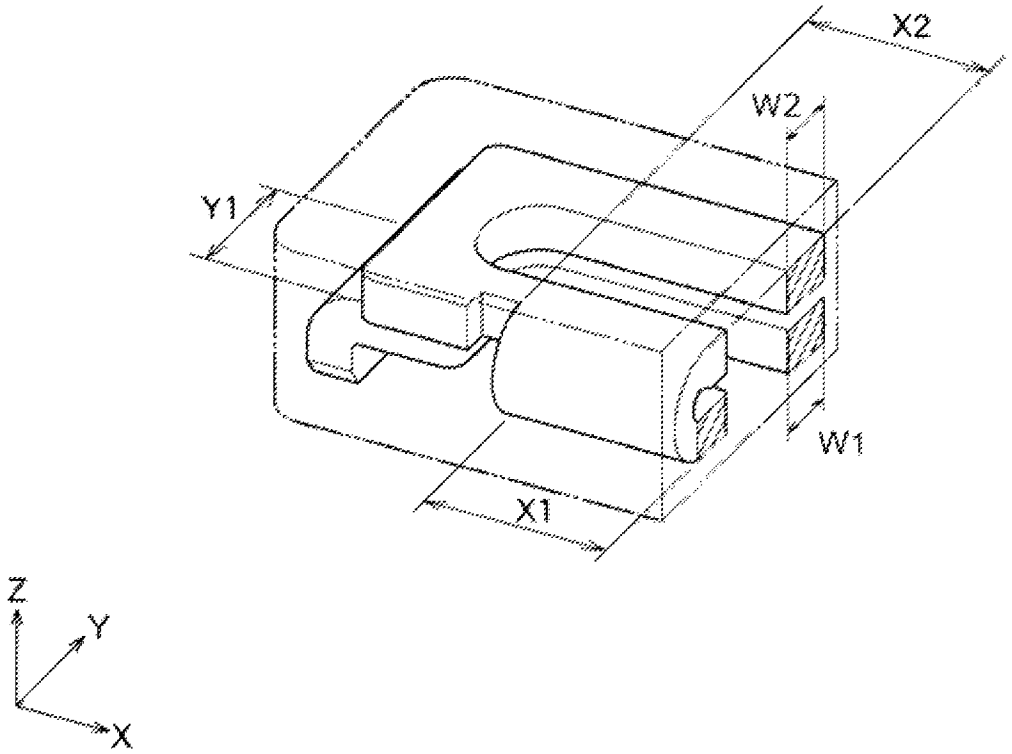
FIG. 2A is a perspective view of the coil component showing a partial cross section of FIG. 2

The first end length X1 shown in FIG. 2 and FIG. 2A is longer than the representative first width W1 of the first coil pattern 61*b* shown in FIG. 4A and FIG. 2A. For example, W1/X1 (the same for W1/X2) is 1 or less, preferably 0.1 or more and less than 1. The representative first width W1 of the first coil pattern 61*b* is equivalent to the representative second width of the second coil pattern 62*b*. The representative first width W1 of the first coil pattern 61*b* is defined as a minimum value of the width in the Y-axis direction of the first coil pattern 61*b* in a portion where the bent joining segment 63 and the first cutout 61*e* are not formed. Similarly, the representative second width W2 of the second coil pattern 62*b* is defined as a minimum value of the width in the Y-axis direction of the second coil pattern 62*b* in a portion where the bent joining segment 63 and the second cutout 62*e* are not formed. The second width W2 is substantially the same as the first width W1.

In the embodiment, the representative first width W1 of the first coil pattern 61*b* shown in FIG. 4A is not particularly limited, but in terms of the relationship with the width W0 of the first opening 61*a* in Y-axis direction, W1/W0 is preferably determined as 0.2 to 2. In addition, the first width W1 is determined so that t1/W1 is preferably 0.3 to 1 in relation to the representative first thickness t1 of the first coil pattern 61*b*. The first opening 61*a* and the second opening 62*a* are arranged to be aligned in the Y-axis direction and in the X-axis direction, and the width of the second opening 62*a* in the Y-axis direction is substantially the same with the width W0 of the first opening 61*a* in the Y-axis direction.

As shown in FIG. 2, in the embodiment, the first conductive plate part 61 has a first lead part 66 connected to the first coil pattern 61*b* at a portion by a predetermined first starting length Y1 (the length in the Y-axis direction) extending from the first pattern start point 61*c* of the first coil pattern 61*b* along the periphery of the first opening 61*a*. The first lead part 66 is bent from a plane including the X-axis and the Y-axis of the first coil pattern 61*b* toward the laminating direction (downward of the Z-axis direction). As shown in FIG. 4B, at the distal end of the first lead part 66, a taper 66*a* having a narrower width toward the distal end is formed.

As shown in FIG. 2, the second conductive plate part 62 has a second lead part 67 connected to the second coil pattern 62*b* at a portion by a predetermined second starting length Y2 (the length in the Y-axis direction) extending from the second pattern starting point 62*c* of the second coil pattern 62*b* along the periphery of the second opening 62*a*. The second lead part 67 is bent from a plane including the X-axis and the Y-axis of the second coil pattern 62*b* downwardly along Z-axis direction, and located outside the first coil pattern 61*b*. A taper 67*a* having a narrower width toward the distal end is formed at the distal end of the second lead part 67. As shown in FIG. 4B, the distal end of the second lead part 67 projecting downward from the lower surface 4B of the core 4, similarly to the distal end of the first lead part 66.

The second starting length Y2 is preferably substantially the same as the first starting length Y1, but it is not always necessary to be the same. These lengths Y1 and Y2 are preferably equal to or greater than the representative first width W1 of the first coil pattern 61*b* shown in FIG. 4A, respectively, and Y1/W1 is preferably one or more, and more preferably 1.2 to 3.

As shown in FIGS. 3, 4A and 4B, the first conductive plate part 61, the second conductive plate part 62, and the bent joining segment 63 are covered with an insulating layer 64 in areas other than the distal ends of the first lead part 66 and the second lead part 67. As will be described later, the first conductive plate part 61, the second conductive plate part 62, and the bent joining segment 63 are made of a single metal plate, and the thickness thereof is not particularly limited, but is preferably 0.1 to 2 mm. The thickness of the insulating layer 64 is not particularly limited, but is preferably 5 to 40 μm.

The metal constituting the first conductive plate part 61, the second conductive plate part 62 and the bent joining segment 63 is not particularly limited, but examples thereof include Cu, Al, Fe, Ag, Au, and alloys thereof. The insulating layer 64 is not particularly limited, but is formed of a metal oxide, a resin, etc.

The metal oxide constituting the insulating layer 64 is not particularly limited, but titanium oxide, alumite, etc. is exemplified. The resin constituting the insulating layer 64 is not particularly limited, but thermoplastic resins such as an epoxy resin, a urethane resin or a polyimide resin, thermosetting resins such as a melamine resin or a phenol resin, an ultraviolet curing resins such as epoxy resin, etc. are exemplified. Note that the method of applying the insulation coating or the oxide coating is not particularly limited, but an electrodeposition method, a vapor deposition method, a sputtering method, etc. are exemplified.

As shown in FIG. 2, in the embodiment, the inner side surface positioned at an end in the longitudinal direction (X-axis direction) of the first opening 61*a* has a first arcuate inner curved surface 61*f* And the outer side surface of the first conductive plate part 61 corresponding to the first arcuate inner curved surface 61*f* has first corner protrusions 61*g*. Further, the inner side surface positioned at an end in the longitudinal direction (X-axis direction) of the second opening 62*a* has a second arcuate inner curved surface 62*f*. And the outer side surface of the second conductive plate part 62 corresponding to the second arcuate inner curved surface 62*f* has second corner protrusions 62*g*.

With such configuration, it becomes possible to extend the magnetic flux to the core 4 as the compressed powder body located near the first corner protrusions 61*g* and the second corner protrusions 62*g*. Thus, it is possible to effectively use the corner part of the core 4 made of the compressed powder body. Further, at the first corner protrusions 61*g*, the cross sectional area of the first conductive plate part 61 is widened and the electric resistance is lowered, and at the second corner protrusions 62*g*, the cross sectional area of the second conductive plate part 62 is widened and the electric resistance is lowered.

As shown in FIGS. 3 and 4A, in the coil component 6 of the embodiment, the inside of the first opening 61*a*, the inside of the second opening 62*a*, the outer surface of the first coil pattern 61*b*, the outer surface of the second coil pattern 62*b* and the outer surface of the bent joining segment 63 are integrally covered with the core 4 made of the compressed powder body containing a magnetic material. An adhesive 8 as an insulating member is filled between the first conductive plate part 61 and the second conductive plate part 62 that are bent at the bent joining segment 63 and laminated. Thereby an entry of the magnetic material powder constituting the core 4 between the first conductive plate part 61 and the second conductive plate part 62 is suppressed. The gap between the first conductive plate part 61 and the second conductive plate part 62 is not particularly limited but is preferably 10 to 500 μm.

The core 4 is formed by compression compacting or injection molding of granules containing magnetic powder and binder. The magnetic powder is not particularly limited, but metal magnetic powder including Sendust (Fe—Si—Al; iron-silicon-aluminum), Fe—Si—Cr (iron-silicon-chromium), Permalloy (Fe—Ni), Carbonyl Iron type, Carbonyl Ni type, amorphous powder, nanocrystal powder, etc. are preferably used.

The grain diameter of the magnetic powder is preferably 0.5 to 50 μm. In the embodiment, it is preferable that the magnetic powder is the metal magnetic grain and the grain periphery is coated with insulation. As the insulation coating, a metal oxide coating, a resin coating, a chemical treated film such as phosphorus, zinc, etc. are exemplified.

However, as the magnetic powder, ferrite magnetic powder such as Mn—Zn, Ni—Cu—Zn, etc. may be used. The binder resin is not particularly limited, but examples thereof include an epoxy resin, a phenol resin, an acrylic resin, a polyester resin, a polyimide, a polyamideimide, a silicone resin, and a combination thereof.

In the embodiment, the lower surface 4B of the core 4 shown in FIG. 1 is a mounting side outer surface to be connected to such as a circuit board. The lower surface 4B is formed substantially in parallel with a plane including X-axis and Y-axis, which are mutually perpendicular. And the winding axis of the coil component 6 is substantially parallel to the Z-axis perpendicular to the plane in which the X-axis and the Y-axis pass through.

Although the size of the inductor element 2 of the embodiment is not particularly limited, for example, the width in X-axis direction is 1.0 to 20 mm, the width in Y-axis direction Y0 is 1.0 to 20 mm and the height Z0 is 1.0 to 10 mm. The inductor element 2 can be used as such as a transformer, a balun, a common mode filter (common mode choke), a circuit element such as a DC/DC converter, a choke coil in a power supply line, a decoupling element, an element for impedance matching, a component element for filter, an antenna element, etc.

Figure 5A:
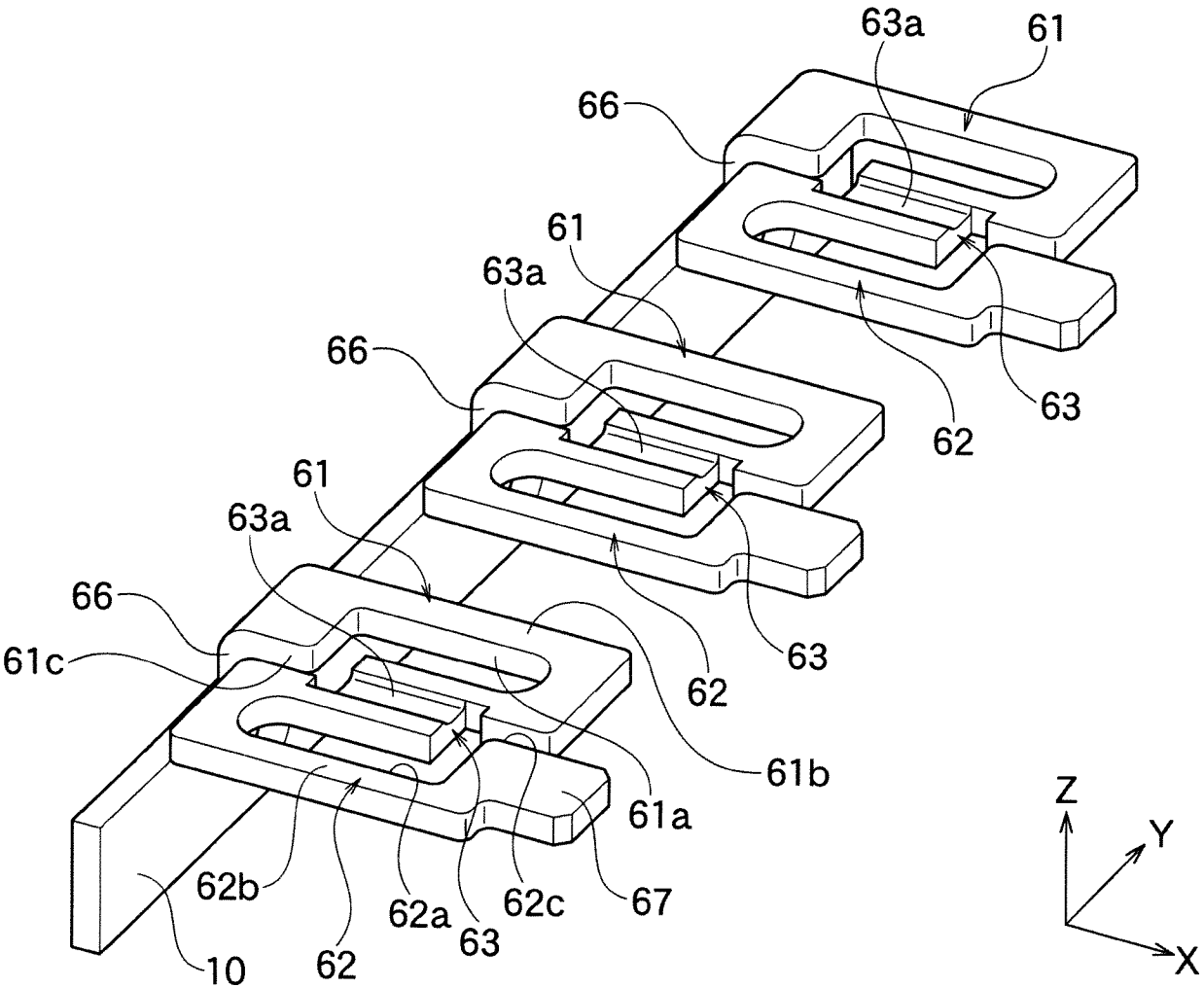
FIG. 5A is a perspective view showing a producing process of the coil component shown in FIG. 2.

Next, a method of producing the inductor element 2 shown in FIGS. 1 to 4B will be described. First, a conductive plate such as a metal plate (e.g. a Sn-plated metal plate) is punched into a shape as shown in FIG. 5A (a stamping step). As shown in FIG. 5A, the multiple first conductive plate parts 61 connected to the lead frame 10 are formed via the lead parts 66 on the conductive plate part after punching.

The second conductive plate part 62 is integrally formed with each first conductive plate part 61 via the bent joining segment 63. The first coil pattern 61*b* having the first opening 61*a* is formed on the first conductive plate part 61. The first lead part 66 is formed at the first pattern start point 61*c* of the first coil pattern 61*b*. The second coil pattern 62*b* having the second opening 62*a* is formed at the second conductive plate part 62. The second lead part 67 is formed at the second pattern starting point 62*c* of the second coil pattern 62*b*.

The recess 63*a* for bending is formed on the surface of the bent joining segment 63, and only at the recess 63*a* for bending, the plate thickness is thinner than the other part. The thickness of the bent joining segment 63 at the recess 63*a* for bending corresponds to the thickness t0 shown in FIG. 4A. The thickness of the first conductive plate part 61 shown in FIG. 5A corresponds to the thickness t1 shown in FIG. 4A. In the state shown in FIG. 5A, the first conductive plate part 61 and the second conductive plate part 62 are substantially parallel to the plane including the X-axis and the Y-axis.

Figure 5B:
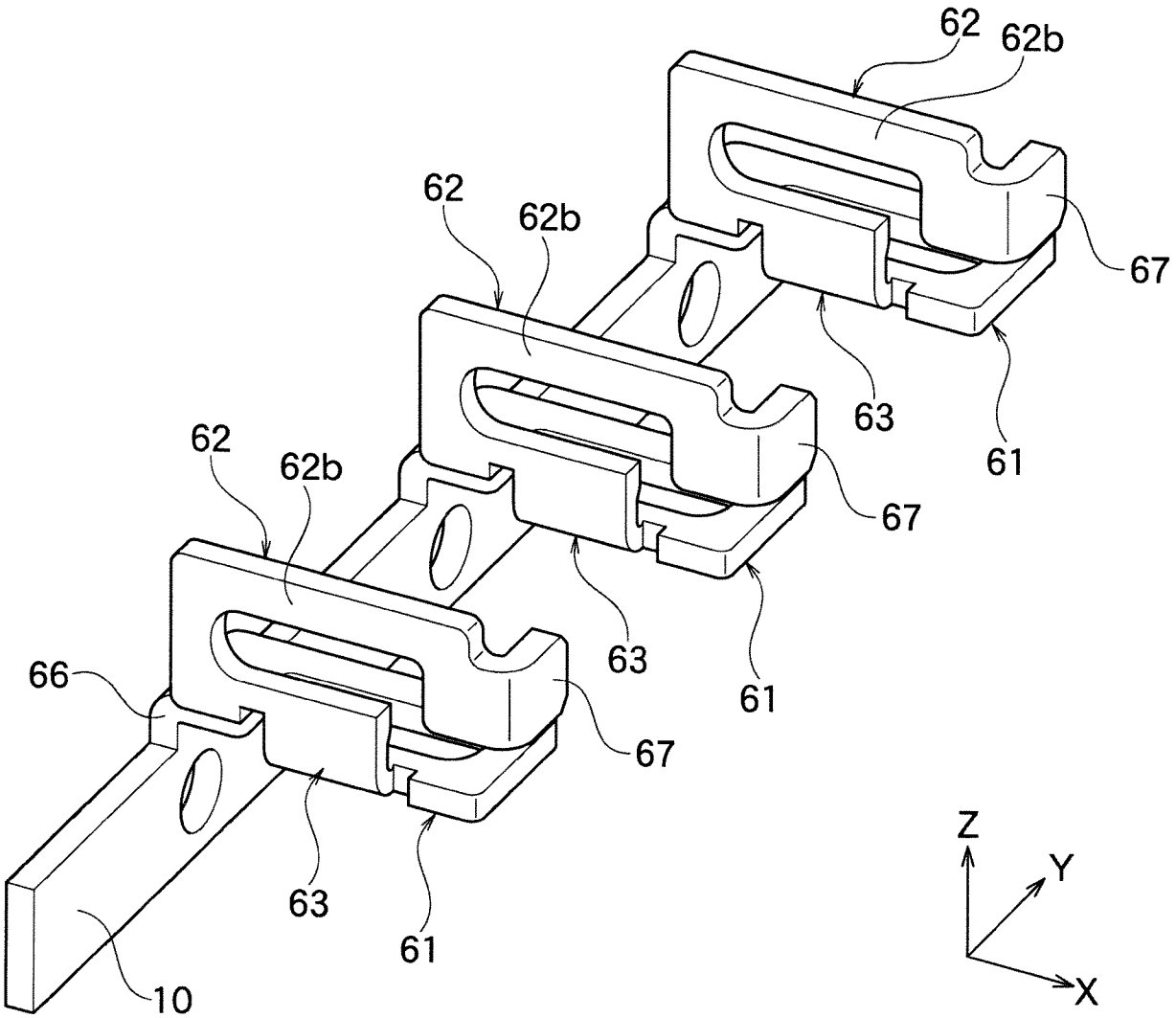
FIG. 5B is a perspective view showing a subsequent step of FIG. 5A.

Next, the second conductive plate part 62 shown in FIG. 5A is bent with respect to the first conductive plate part 61, with the bent joining segment 63 as a fulcrum. And as shown in FIG. 5B, the second conductive plate part 62 is bent substantially perpendicular to the first conductive plate part 61. In this state, the insulation coating is applied to the surfaces of the first conductive plate part 61, the second conductive plate part 62 and the bent joining segment 63 (the insulation coating process). In this process, an insulating resin layer is formed on the surfaces of the first conductive plate part 61, the second conductive plate part 62, and the bent joining segment 63 by electrodeposition, followed by drying and heat treatment as necessary. Then, an insulating layer 64 (see FIGS. 3 to 4B) covering the surfaces of the conductive plate parts 61 and 62 and the bent joining segment 63 is formed.

As a polymer used for the electrodeposition solution for forming the insulating layer 64 by electrodeposition, various anionic or cationic synthetic polymer resins having electrodeposition properties can be mentioned. In order to impart adhesiveness to the polymer resins, an adhesive resin such as a rosin type, a terpene type, a petroleum resin, etc. may be added as required.

In particular, from the viewpoint of insulation, strength, and chemical stability, it is preferable that the insulating layer 64 is a polyimide resin. For example, the insulating layer 64 may be an insulating resin layer which is formed by electrodeposing an electrodeposition coating composition including polyimide resin containing an ionic group, an organic solvent capable of dissolving the polyimide resin, water, an ionic compound having polarity different from that of the ionic group, followed by drying and heat treating. Note that the insulating layer 64 may also be formed by heating and melting the resin, applying the molten resin to each of the conductive plate parts 61 and 62, and then curing the resin. Before or after the processes thereof, the second lead part 67 may be bent in a substantially vertical direction from the plane of the first coil pattern 62*b*.

Figure 5C:
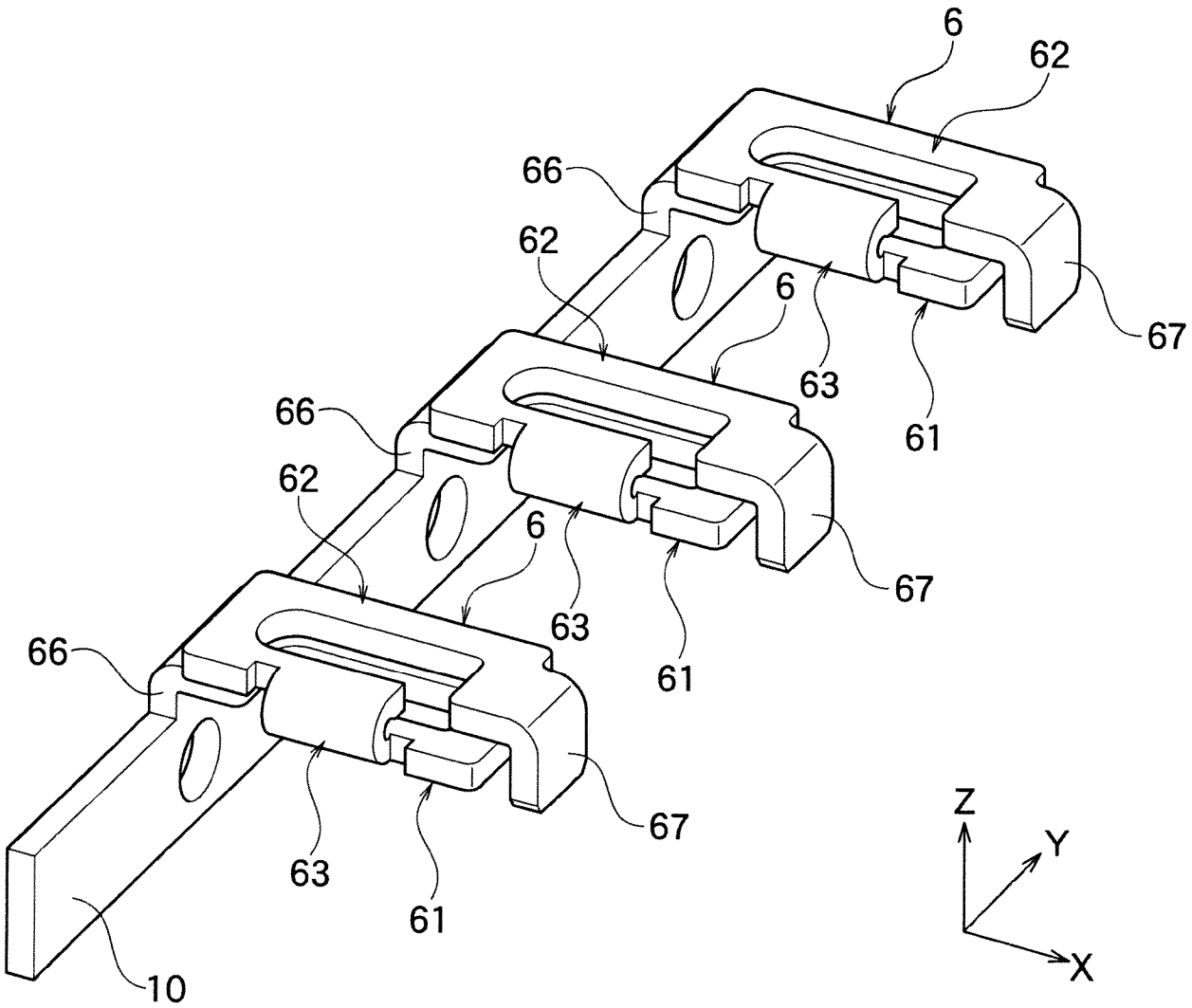
FIG. 5C is a perspective view showing a subsequent step of FIG. 5B.

Next, as shown in FIG. 5C, the second conductive plate part 62 is further bent with respect to the first conductive plate part 61 with the bent joining segment 63 as the fulcrum. The second conductive plate part 62 is laminated on the first conductive plate part 61 (a laminating step) in parallel to form the coil component 6. Before or after the laminating step, as shown in FIGS. 3 and 4A, the adhesive 8 as an insulating member is filled between the first conductive plate part 61 and the second conductive plate part 62.

Next, the main part of the coil component 6 is inserted into a press mold, the distal ends of the lead parts 66 and 67 are exposed from the press mold, and the core 4 is formed by compression compacting in the press mold (a molding step). At the time of compression compacting, the mixture containing the magnetic powder and the binder resin is filled in the cavity of the press mold, and the whole is heat compressed, whereby the inductor element 2 shown in FIGS. 1 to 4B is obtained.

The heating temperature during the heat compression is preferably 50 to 300° C. and a compression pressure is preferably 1 to 400 Pa. As a method for the compression compacting, the press mold may be used, or oil pressure or water pressure may be used. In compression compacting, instead of the above-mentioned mixture, only the resin may be filled in the cavity. Also, the molding step may be omitted, and the main part of the coil component 6 may simply put into an exterior packaging (a sealing body) and fixed.

The lead frame 10 shown in FIG. 5C may be removed by cutting with a cutting tool after forming the core 4 by compression compacting, or it may be removed before forming the core 4. Although not shown in the drawing, it is preferable that the tapers 66*a* and 67*a* shown in FIG. 4B are formed in advance on the distal ends of the lead parts 66 and 67 protruding from the core 4. Further, in the core 4, it is preferable that the tapered concave 4D corresponding to the tapers 66*a*, 67*a* is formed. As shown in FIGS. 3 and 4B, the insulating layer 64 coated on the distal ends of the lead parts 66 and 67 is preferably removed before forming the core 4, but the insulating layer 64 may be removed after forming the core 4.

As shown in FIG. 2, in the coil component 6 according to the embodiment, the bent joining segment 63 directly connects a part of the first outer edge of the first coil pattern 61*b* forming the first opening 61*a* and a part of the second outer edge of the second coil pattern 62*b* forming the second opening 62*a*. Therefore, it is possible to minimize the protruding amount in the Y-axis direction of the bent joining segment 63 protruding from the annular first coil pattern 61*b* and the annular second coil pattern 62*b*. Thus, it is easy to miniaturize the coil component 6.

In addition, since it is easy to reduce the size of the coil component 6, it is also easy to reduce the size of the inductor element 2 having the coil component 6 and the core 4 including the compressed powder body in which the coil component 6 is integrally incorporated. Further, it is easy to make the first conductive plate part 61 defining the first coil pattern 61*b* and the second conductive plate part 62 defining the second coil pattern 62*b* to be relatively thick, and it becomes possible to increase the current flow flowing through the coil patterns 61*b* and 62*b*.

In the embodiment, the width of the connection between the bent joining segment 63 and the first coil pattern 61*b* corresponds to the first end length X1, and the width of the connection between the bent joining segment 63 and the second coil pattern 62*b* corresponds to the second end length X2. And by keeping the lengths X1, X2 within the predetermined ranges, it is possible to suppress an increase in the electrical resistance at these connections.

In the embodiment, by setting the end lengths X1 and X2 shown in FIG. 2 to be longer than the first width W1 of the first coil pattern shown in FIG. 4A, it becomes possible to suppress a decrease in the cross sectional area of the bent joining segment 63 and to suppress an increase in electrical resistance, even when the thickness t0 of the bent joining segment 63 is made thin. Although it is preferable that the width of the bent joining segment 63 is substantially the same along the bending direction, it is not necessarily arranged at the same position toward the laminating direction, and both edges in the width direction of the bent joining segment 63 in X axis direction may be inclined.

Furthermore, in the embodiment, since the recess 63*a* for bending is formed on the bent inner surface of the bent joining segment 63, it is possible to further reduce the protruding amount of the bent joining segment 63 in the Y-axis direction, which protrudes from the annular first coil pattern 61*b* and the annular second coil pattern 62*b*. Therefore, it is possible to further reduce the size of the coil component 6.

Further, by reducing the thickness t0 (see FIG. 4A) of the bent joining segment 63, it becomes easy to further reduce the gap in the Z-axis direction between the first coil pattern 61*b* and the second coil pattern 62*b*. As a result, it becomes possible to strengthen the magnetic coupling between these coil patterns 61*b*, 62*b*, and such as the metal magnetic powder contained in the core 4 becomes difficult to enter between the coil patterns 61*b*, 62*b*. Thus, it becomes difficult to generate such as a short-circuit failure.

In the embodiment, as shown in FIG. 4B, by forming the tapers 66*a*, 67*a* at the distal ends of the first lead part 66 and the second lead part 67, for example, a contact between the core 4 including the metallic magnetic material and a metal exposed surface of the tapers 66*a* and 67*a* can be easily avoided. Thus, the short circuit of the lead parts with the metal magnetic body can be prevented.

In the embodiment, since the conductive plate parts 61 and 62 are covered with the insulating layer 64 except for the distal ends of the lead parts 66 and 67, it is possible to easily avoid a contact of lead parts with the core 4 including such as the metal magnetic body. Thus, it is possible to effectively prevent a short circuit between the metal exposed surface of the conductive plate parts 61 and 62 and the metal magnetic body.

Further, in the embodiment, the second conductive plate part 62 has a second lead part connected to the second coil pattern 62*b* by a predetermined second starting length Y2 extending from the second pattern starting point 62*c* of the second coil pattern along the periphery of the second opening 62*a*. The second lead part 67 is bent from a plane of the second coil pattern 62*b* toward the laminating direction, and located outside the first coil pattern 61*b*. With such configuration, the coil component 6 can be further reduced in size.

Second Embodiment

Figure 6:
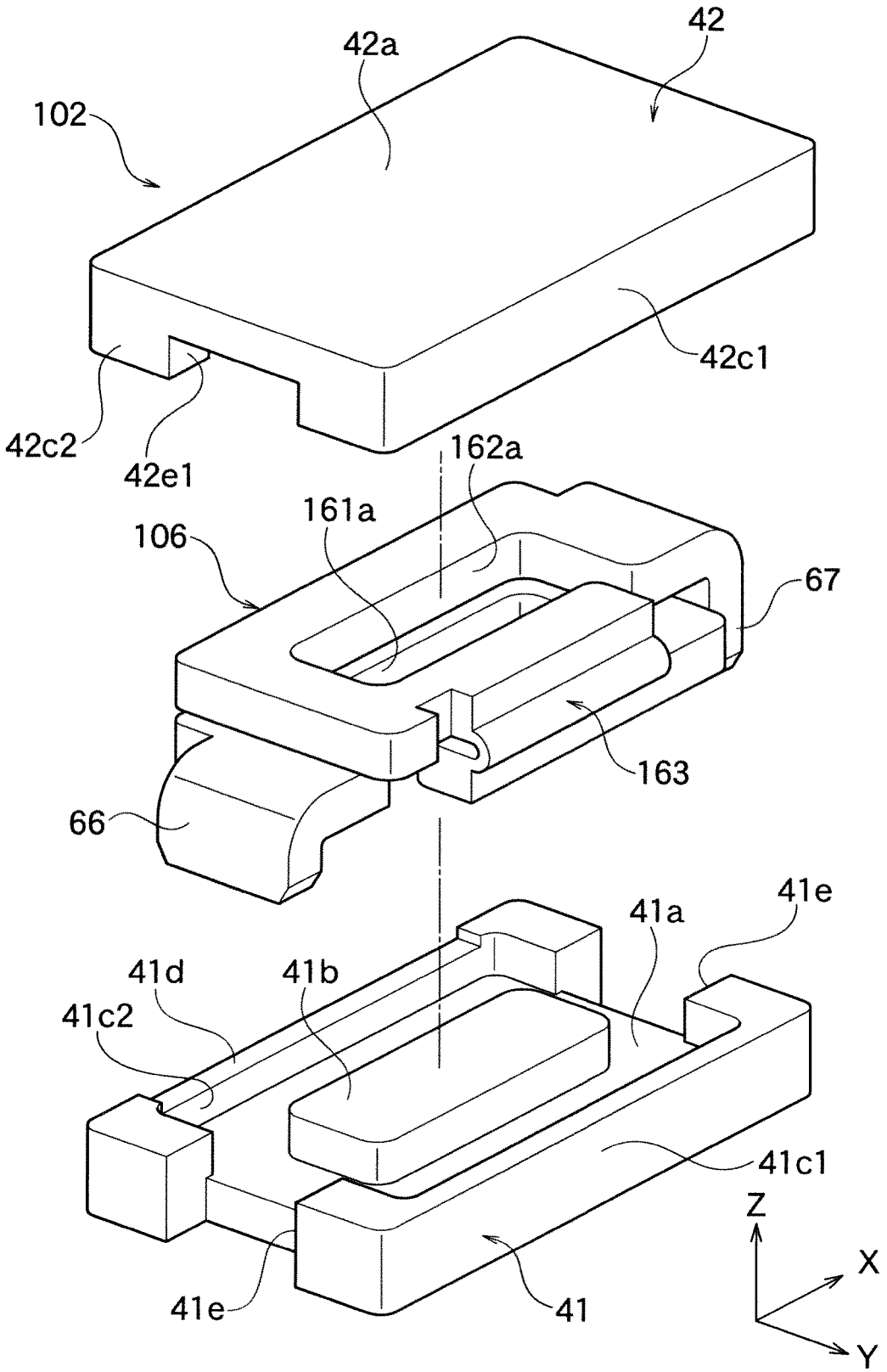
FIG. 6 is an exploded perspective view of the coil device according to another embodiment of the invention.

Shown in FIG. 6, the inductor element 102 of the embodiment is similar to the inductor element 2 of the first embodiment, except the configuration of the coil component 106 is different and the configuration of the core (core members 41 and 42) is different. Hereinafter, parts different from the first embodiment will be described in detail, and description of common parts will be omitted. According to the members shown in the drawings, the common members are denoted by the similar reference numerals, and descriptions thereof will be partly omitted.

Figure 7A:
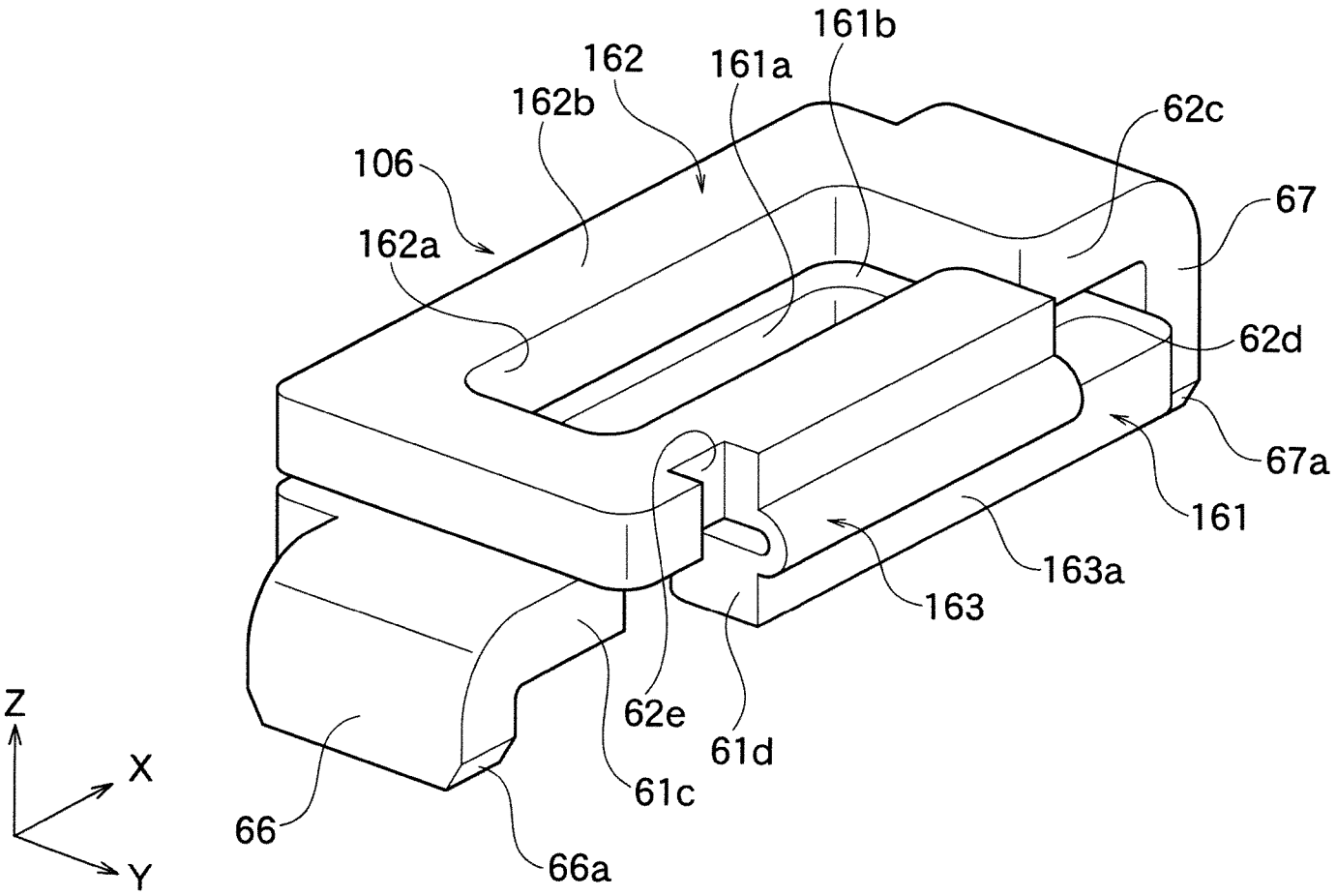
FIG. 7A is an enlarged perspective view of the coil component shown in FIG. 6.

As shown in FIG. 7A, the coil component 106 has two first and second conductive plate parts 161 and 162 laminated in the Z-axis direction (laminating direction). A first coil pattern 161*b* having a first opening 161*a* is formed on the first conductive plate part 161. The second conductive plate part 162 is disposed at a predetermined interval in the laminating (Z-axis) direction with respect to the first conductive plate part 161. A second coil pattern 162*b* having a second opening 162*a* is formed on the second conductive plate part 162. The second opening 162*a* communicates with the first opening 161*a* in the Z-axis direction and has substantially the same size with the first opening 161*a*.

In the embodiment, the first conductive plate part 161 and the second conductive plate part 162 are connected by a bent joining segment 163, made of the same single plate as the first conductive plate part 61 and the second conductive plate part 62. The bent joining segment 163 directly connect a part of the first outer edge of the first coil pattern 161*b* forming the first opening 161*a* and a part of the second outer edge of the second coil pattern 162*b* forming the second opening 162*a*.

That is, the bent joining segment 163 is integrally connected to the first outer edge of the first coil pattern 161*b* by the predetermined first end length X1 (see FIG. 2) extending from the first pattern end point 161*d* of the first coil pattern 161*b* along a periphery of the first opening 161*a*. Further, the bent joining segment 163 is integrally connected to the second outer edge of the second coil pattern 162*b* by the predetermined second end length X2 (see FIG. 2) extending from the second pattern end point 162*d* of the second coil pattern 162*b* along a periphery of the second opening 162*a*.

In the embodiment, a recess 163*a* for bending is formed on the bent outer surface of the bent joining segment 63. At the recess 63*a* for bending, the thickness t0 (see FIG. 4A) of the bent joining segment 163 is smaller than the representative first thickness t1 (see FIG. 4A) of the first coil pattern 161*b*.

In the embodiment, the core has a lower core member 41 and an upper core member 42, which are formed in advance as separate members and are combined with the coil component 106 in a later step. The lower core member 41 has a base 41*a* having a substantially square plate shape. The outer legs 41*c*1 and 41*c*2 are integrally formed around the base 41*a*. The outer legs 41*c*1 and 41*c*2 are formed to protrude from the base 41*a* so as to have a predetermined height in the Z-axis direction and are formed to be separated from each other by a pair of cutouts 41*e* for lead.

The pair of cutouts 41*e* for lead are formed so as to allow the first lead part 66 and the second lead part 67, formed on both sides in the X-axis direction of the coil component 106, to extend outside of X-axis direction and downside of Z-axis direction from the base 41*a*. Also, the cutouts 41*e* make the outer legs 41*c*1 and 41*c*2 mutually separated.

In the substantially central part in the X-axis and the Y-axis directions of the base 41*a*, a central leg 41*b* is integrally formed so as to protrude in the Z-axis direction. The central leg 41*b* has a shape which can be inserted inside the first opening 161*a* of the coil device 106 and has substantially the same shape but slightly smaller than the internal shape of the first opening 161*a*.

Figure 7B:
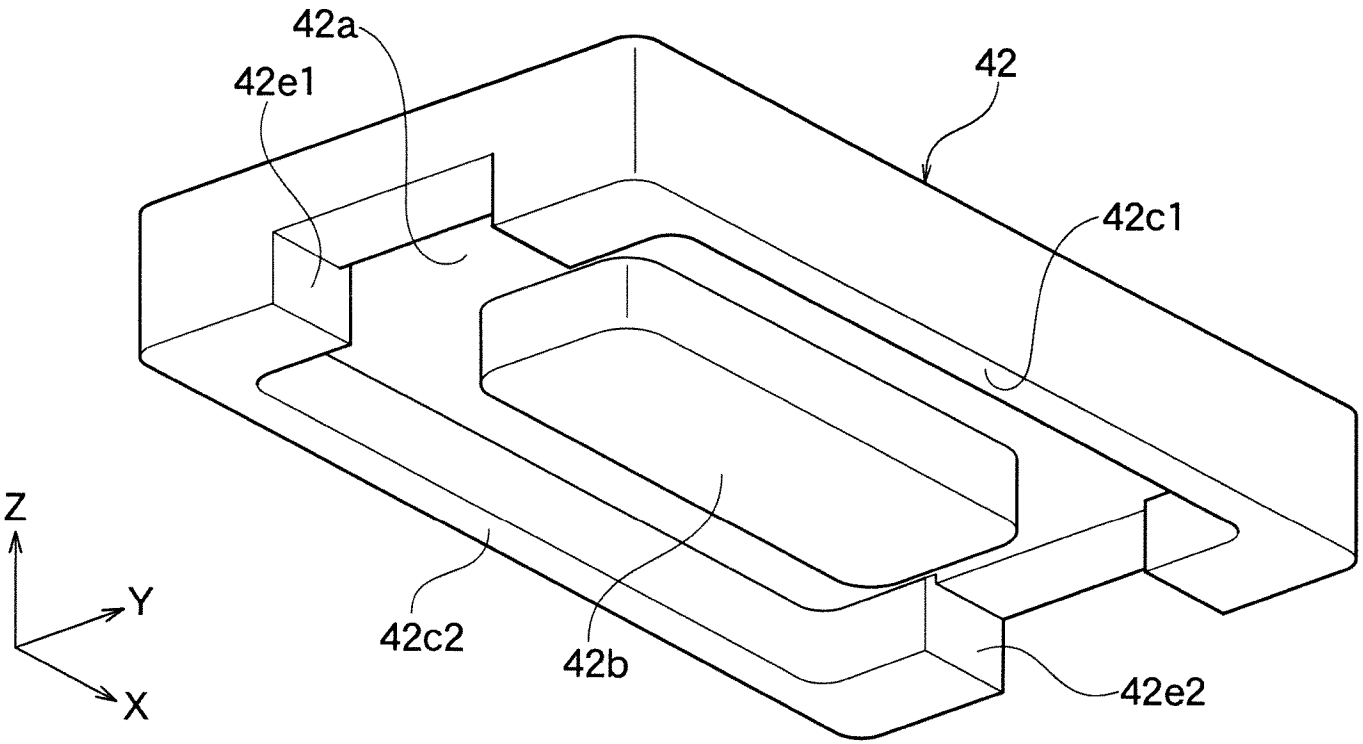
FIG. 7B is an enlarged perspective view of the upper core shown in FIG. 6, viewed from different angles.

As shown in FIG. 7B, the upper core member 42 has a base 42*a* having a substantially square plate shape. In the substantially central part in the X-axis and the Y-axis directions of the base 42*a*, a central leg 42*b* is integrally formed so as to protrude in the Z-axis direction. The central leg 42*b* has a shape which can be inserted into the the second opening 162*a* of the coil device 106 and has substantially the same shape but slightly smaller than the internal shape of the second opening 162*a*.

Further, the outer legs 42*c*1 and 42*c*2 are integrally formed around the base 42*a*. The outer legs 42*c*1 and 42*c*2 are formed to protrude from the base 42*a* so as to have a predetermined height in the Z-axis direction and are formed to be separated from each other by a pair of cutouts 42*e* for lead.

The pair of cutouts 42*e*1 and 42*e*2 for lead are formed so as to allow the first lead part 66 and the second lead part 67, formed on both sides in the X-axis direction of the coil component 106 shown in FIG. 7A, to extend outside of X-axis direction from the base 42*a*. Also, the cutouts 42*e*1 and 42*e*2 make the outer legs 42*c*1 and 42*c*2 mutually separated.

The first lead part 66 of the coil component 106 is taken out from the first conductive plate part 161, a second lead part 67 is taken out from the second conductive plate part 162. Thus, taken out positions thereof in the Z-axis direction are different from each other. Therefore, the cutout 42*e*1 for lead corresponding to the first lead part 66 is not necessarily provided, and even if it is provided, the depth of the cutout 42*e*1 in the Z-axis direction may be set to be shallow compared to that of the other cutout 42*e*2 for lead.

In the embodiment, the central leg 41*b* of the lower core member 41 enters the first opening 161*a* of the coil component 106, the central leg 42*b* of the upper core member 42 enters the second opening 162*a*. And distal ends of the central legs 41*b* and 42*b* mutually abut to contact each other or face each other with a predetermined gap, in order to make a part of the magnetic circuit.

Further, the outer leg 41*c*1 of the core member 41 and the outer leg 42*c*1 of the core member 42 abut to contact each other in Z-axis direction at an outside of the bent joining segment 163 of the coil component 106, in order to constitute a part of the magnetic circuit. In addition, the outer leg 41*c*2 of the core member 41 and the outer leg 42*c*2 of the core member 42 face each other in Z-axis direction at the opposite outside of the bent joining segment 163 of the coil component 106 in order to constitute a part of the magnetic circuit.

As shown in FIG. 6, a step 41*d* may be formed on one of the outer legs 41*c*2 (and/or 42*c*2), and the height in Z-axis direction may be smaller than the same of the other outer leg 41*c*1 (and/or 42*c*1). The step 41*d* is formed on the outer leg 41*c*2 (and/or 42*c*2) along the X-axis direction so as to correspond to the position at the opposite side in the Y-axis direction from the bent joining segment 163 of the coil component 106.

The length of the stepped part 41*d* in the X-axis direction is preferably substantially the same as the length of the bent joining segment 163 of the coil device 106 in the X-axis direction. In the coil component 106, as compared with a portion where the bent joining segment 163 is formed, the magnetic property as a coil becomes stronger in a portion of the coil component 106 positioned on the opposite side of the bent joining segment 163 in the Y-axis direction. Therefore, by providing the step 41*d* in the outer leg 41*c*2 (and/or 42*c*2) of the core member 41 or 42 and providing a gap in the facing part thereof, it becomes easy to balance the magnetic property on both sides of the coil device 106 in the Y-axis direction.

The core members 41 and 42 may bond at least at four corners with such as an adhesive. The core members 41 and 42 may bond between the outer leg 41*c*1 and the outer leg 42*c*1 and between the outer leg 41*c*2 and the outer leg 42*c*2. The core members 41 and 42 will surround main parts of the coil component 106 other than the lead parts 66 and 67. That is, bases 41*a*, 42*a* of the core members 41, 42 cover the outer surface of the first coil pattern 161*b* in the axial direction and the outer surface of the second coil pattern 162*b* in the axial core direction, respectively. The outer side surface of the first coil pattern 161*b*, the outer side surface of the second coil pattern 162*b*, and the outer side surface of the bent joining segment 163 are covered with the outer legs 41*c*1, 41*c*2, 42*c*1, and 42*c*2.

In the embodiment, the core members 41 and 42 can each be made of the magnetic material or the resin which are the same material as the core 4 of the first embodiment. Unlike the core 4, the core members 41 and 42 can also be made of a magnetic material of a sintered body not including the resin, since it is not necessary to integrally form with coil component 106 including metals. In the embodiment, unlike the core 4, the core members 41 and 42 can be made of magnetic materials such as Ni—Zn based ferrite, Mn—Zn based ferrite, Fe based powder, Fe-based sintered body, etc.

The coil component 106 and the inductor element 102 according to the embodiment have the same configurations as the coil component 6 and the inductor element 2 of the first embodiment and exhibit similar operational effects, except the descriptions above.

The invention is not limited to the above-described embodiments and can be variously modified within the scope of the invention.

For example, the coil component 6 includes two conductive plate parts 61 and 62 and a single bent joining segment 63 in the above embodiment, however, it may include three or more conductive plate parts and two or more bent joining segments.

DESCRIPTION OF THE REFERENCE NUMERALS

2, 102 . . . Inductor element (Coil device)
4 . . . Core (Compressed powder body)
4A . . . Upper surface
4B . . . Lower surface
4C . . . Side surface
4D . . . Tapered concave
41 . . . Lower core member
41*a* . . . Base
41*b* . . . Central leg
41*c*1, 41*c*2 . . . Outer leg
41*d* . . . Step
41*e* . . . Cutout for lead
42 . . . Upper core member
42*a* . . . Base
42*b* . . . Central leg
42*c*1, 42*c*2 . . . Outer leg
42*e* . . . Cutout for lead
6, 106 . . . Coil component
61, 161 . . . First conductive plate part
61*a*, 161*a* . . . First opening
61*b*, 161*b* . . . First coil pattern
61*c* . . . First pattern start point
61*d* . . . First pattern end point
61*e* . . . First cutout
61*f* . . . First arcuate inner curved surface
61*g* . . . First corner protrusion
62, 162 . . . Second conductive plate part
62*a*, 162*a* . . . Second opening
62*b*, 162*b* . . . Second coil pattern
62*c* . . . Second pattern start point
62*d* . . . Second pattern end point
62*e* . . . Second cutout
62*f* . . . Second arcuate inner curved surface
62*g* . . . Second corner protrusion
63, 163 . . . Bent joining segment
63*a*, 163*a* . . . Recess for bending
64 . . . Insulating layer
66 . . . First lead part
66*a* . . . Taper
67 . . . Second lead part
67*a* . . . Taper
8 . . . Adhesive (Insulating member)
10 . . . Lead frame

What is claimed is:

1. A coil component having a laminating direction, comprising:

a first conductive plate part formed with a first coil pattern having a first opening;

a second conductive plate part formed with a second coil pattern having a second opening and disposed at a predetermined interval in the laminating direction with respect to the first conductive plate part; and a bent joining segment connecting the first conductive plate part and the second conductive plate part, wherein the first conductive plate part, the second conductive plate part and the bent joining segment are made of the same single plate, and the bent joining segment directly connects a part of a first outer edge of the first coil pattern contacting the first opening with a part of a second outer edge of the second coil pattern contacting the second opening, and wherein a recess for bending is formed on a bent inner surface or a bent outer surface of the bent joining segment, and a thickness of the bent joining segment is smaller than a first thickness of the first coil pattern and is smaller than a second thickness of the second coil pattern.

2. The coil component according to claim 1, wherein the bent joining segment is connected to the first coil pattern by a predetermined first end length extending from the first pattern end point of the first coil pattern along a periphery of the first opening, and the second coil pattern by a predetermined second end length extending from the second pattern end point of the second coil pattern along a periphery of the second opening, and wherein the first end length is longer than a first width of the first coil pattern, the second end length is longer than a second width of the second coil pattern, and the first end length and the second end length are substantially the same.

3. The coil component according to claim 1, wherein an insulating member is interposed between the first coil pattern and the second coil pattern.

4. A coil device comprising:

the coil component according to claim 1; and a core member, made by compacting a magnetic material and mounting the coil component therein, wherein the core member comprises:

a center leg which is inserted into an inside of the first opening and an inside of the second opening of the coil component;

a planar base placed at an outer surface of the first coil pattern in the axial direction and an outer surface of the second coil pattern in the axial direction; and an outer leg placed at an outer side surface of the first coil pattern, an outer side surface of the second coil pattern, and an outer side surface of the bent joining segment.

5. A coil device comprising:

the coil component according to claim 1; and a compressed powder body containing a magnetic material, integrally covering an inside of the first opening, an inside of the second opening, an outer surface of the first coil pattern, an outer surface of the second coil pattern, and an outer surface of the bent joining segment of the coil component.

6. A coil component having a laminating direction, comprising:

a first conductive plate part formed with a first coil pattern having a first opening;

a second conductive plate part formed with a second coil pattern having a second opening and disposed at a predetermined interval in the laminating direction with respect to the first conductive plate part; and a bent joining segment connecting the first conductive plate part and the second conductive plate part, wherein the first conductive plate part, the second conductive plate part and the bent joining segment are made of the same single plate, and the bent joining segment directly connects a part of a first outer edge of the first coil pattern contacting the first opening with a part of a second outer edge of the second coil pattern contacting the second opening, and wherein the bent joining segment is connected to the first coil pattern by a predetermined first end length extending from the first pattern end point of the first coil pattern along a periphery of the first opening, and the second coil pattern by a predetermined second end length extending from the second pattern end point of the second coil pattern along a periphery of the second opening, and wherein a first cutout recessed in the direction towards the first opening is formed on the first coil pattern at a position apart from the first pattern end point by the first end length, and a second cutout recessed in the direction towards the second opening is formed on the second coil pattern at a position apart from the second pattern end point by the second end length.

7. The coil component according to claim 6, wherein the first conductive plate part has a first lead part connected to the first coil pattern at a first start point by a predetermined first start length extending from the first pattern start point of the first coil pattern along the periphery of the first opening.

8. The coil component according to claim 7, wherein the first conductive plate part except a distal end of the first lead part is covered with an insulating layer.

9. The coil component according to claim 6, wherein the second conductive plate part has a second lead part connected to the second coil pattern at a second start point by a predetermined second start length extending from the second pattern start point of the second coil pattern along the periphery of the second opening, and the second lead part is bent from a plane of the second coil pattern toward the laminating direction and located outside the first coil pattern.

10. A coil device comprising:

the coil component according to claim 6; and a compressed powder body containing a magnetic material, integrally covering an inside of the first opening, an inside of the second opening, an outer surface of the first coil pattern, an outer surface of the second coil pattern, and an outer surface of the bent joining segment of the coil component.

11. A coil component having a laminating direction, comprising:

a first conductive plate part formed with a first coil pattern having a first opening;

a second conductive plate part formed with a second coil pattern having a second opening and disposed at a predetermined interval in the laminating direction with respect to the first conductive plate part; and a bent joining segment connecting the first conductive plate part and the second conductive plate part, wherein the first conductive plate part, the second conductive plate part and the bent joining segment are made of the same single plate, and the bent joining segment directly connects a part of a first outer edge of the first coil pattern contacting the first opening with a part of a second outer edge of the second coil pattern contacting the second opening, and wherein an inner side surface positioned at an end in a longitudinal direction of the first opening has a first arcuate inner curved surface, an outer side surface of the first conductive plate part corresponding to the first arcuate inner curved surface has a first corner protrusion, an inner side surface positioned at an end in a longitudinal direction of the second opening has a second arcuate inner curved surface, and an outer side surface of the second conductive plate part corresponding to the second arcuate inner curved surface has a second corner protrusion.

12. A coil device comprising:

the coil component according to claim 11; and a compressed powder body containing a magnetic material, integrally covering an inside of the first opening, an inside of the second opening, an outer surface of the first coil pattern, an outer surface of the second coil pattern, and an outer surface of the bent joining segment of the coil component.

13. The coil component according to claim 11, wherein the bent joining segment is connected to the first coil pattern by a predetermined first end length extending from the first pattern end point of the first coil pattern along a periphery of the first opening, and the second coil pattern by a predetermined second end length extending from the second pattern end point of the second coil pattern along a periphery of the second opening, and wherein the first end length is longer than a first width of the first coil pattern, the second end length is longer than a second width of the second coil pattern, and the first end length and the second end length are substantially the same.

14. A coil component having a laminating direction, comprising:

a first conductive plate part formed with a first coil pattern having a first opening;

a second conductive plate part formed with a second coil pattern having a second opening and disposed at a predetermined interval in the laminating direction with respect to the first conductive plate part; and a bent joining segment connecting the first conductive plate part and the second conductive plate part, wherein the first conductive plate part, the second conductive plate part and the bent joining segment are made of the same single plate, and the bent joining segment directly connects a part of a first outer edge of the first coil pattern contacting the first opening with a part of a second outer edge of the second coil pattern contacting the second opening, and wherein the first conductive plate part has a first lead part connected to the first coil pattern at a first start point by a predetermined first start length extending from the first pattern start point of the first coil pattern along the periphery of the first opening, and wherein the first lead part is bent from a plane of the first coil pattern toward the laminating direction, and a distal end of the first lead part has a taper having a narrower width toward the distal end.

15. The coil component according to claim 14, wherein the first conductive plate part except a distal end of the first lead part is covered with an insulating layer.

16. A coil device comprising:

the coil component according to claim 8; and a compressed powder body containing a magnetic material, integrally covering an inside of the first opening, an inside of the second opening, an outer surface of the first coil pattern, an outer surface of the second coil pattern, and an outer surface of the bent joining segment of the coil component.

17. A coil component having a laminating direction, comprising:

a first conductive plate part formed with a first coil pattern having a first opening;

a second conductive plate part formed with a second coil pattern having a second opening and disposed at a predetermined interval in the laminating direction with respect to the first conductive plate part; and a bent joining segment connecting the first conductive plate part and the second conductive plate part, wherein the first conductive plate part, the second conductive plate part and the bent joining segment are made of the same single plate, and the bent joining segment directly connects a part of a first outer edge of the first coil pattern contacting the first opening with a part of a second outer edge of the second coil pattern contacting the second opening, and wherein the bent joining segment is connected to the first coil pattern by a predetermined first end length extending from the first pattern end point of the first coil pattern along a periphery of the first opening, and the second coil pattern by a predetermined second end length extending from the second pattern end point of the second coil pattern along a periphery of the second opening, and wherein the first end length is longer than a first width of the first coil pattern, the second end length is longer than a second width of the second coil pattern, and the first end length and the second end length are substantially the same, and wherein a first cutout recessed in the direction towards the first opening is formed on the first coil pattern at a position apart from the first pattern end point by the first end length, and a second cutout recessed in the direction towards the second opening is formed on the second coil pattern at a position apart from the second pattern end point by the second end length.

* * * * *